US007717531B2

(12) United States Patent
Paasch

(10) Patent No.: US 7,717,531 B2
(45) **Date of Patent: *May 18, 2010**

(54) PRINT HEAD APPARATUS WITH MALFUNCTION DETECTOR

(75) Inventor: Robert Paasch, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/479,096

(22) Filed: Jun. 30, 2006

(65) Prior Publication Data

US 2006/0244777 A1 Nov. 2, 2006

Related U.S. Application Data

(62) Division of application No. 09/416,618, filed on Oct. 12, 1999, now Pat. No. 7,249,818.

(51) Int. Cl.
*B41J 2/05* (2006.01)

(52) U.S. Cl. ..... 347/14; 347/5; 347/19

(58) Field of Classification Search ..... 347/9, 347/12, 19, 23, 5, 14
See application file for complete search history.

(56) References Cited

U.S. PATENT DOCUMENTS 4,293,867 A 10/1981 Isayama
4,498,089 A 2/1985 Scardovi
4,668,965 A 5/1987 Tanaka et al.
4,714,935 A 12/1987 Yamamoto et al.
4,835,435 A 5/1989 Yeung et al.
4,872,028 A 10/1989 Lloyd
4,907,013 A 3/1990 Hubbard et al.
4,922,268 A 5/1990 Osborne
4,980,699 A * 12/1990 Tanabe et al. ..... 347/14
5,036,340 A 7/1991 Osborne
5,589,863 A 12/1996 Janse Van Rensburg et al.
5,644,343 A 7/1997 Allen
5,646,654 A 7/1997 Widder
5,929,875 A 7/1999 Su et al.
6,116,710 A * 9/2000 Tajika et al. ..... 347/14
7,401,876 B2 * 7/2008 Sekiguchi ..... 347/14

FOREIGN PATENT DOCUMENTS

JP 02236160 9/1990
JP 09-201967 * 8/1997
JP 09201967 8/1997
JP 11070659 3/1999

* cited by examiner

*Primary Examiner*—Lam S Nguyen

(57) ABSTRACT

A print head and method that are capable of detecting a plurality of performance conditions such as a dry-fire, no-fire or clogged-nozzle condition. Pressure wave sensors within a print head are disclosed that are capable of detecting pressure waves generated by the firing of an ink expulsion mechanism. The characteristics of the pressure wave generated by the firing event (e.g., magnitude and timing) are indicative of the operating condition within the head. Multiple sensor types are disclosed.

7 Claims, 2 Drawing Sheets

PRINT HEAD APPARATUS WITH MALFUNCTION DETECTOR

CROSS-REFERENCE TO RELATED APPLICATIONS

This is a divisional of U.S. patent application Ser. No. 09/416,618 filed on Oct. 12, 1999, now U.S. Pat. No. 7,249, 818, entitled "Print Head Apparatus With Malfunction Detector", by Paasch, which is hereby incorporated by reference herein in its entirety.

FIELD OF THE INVENTION

The present invention relates to print heads used in printers and plotters and the like and, more specifically, to detecting malfunctions within such print heads.

BACKGROUND OF THE INVENTION

Printers and plotters are known in the art and include those made by Hewlett-Packard, Canon and Epson, amongst others. In the discussion that follows, printers and plotters are referred to collectively with the term "printers". Problems associated with current printers and print head arrangements include that the print head may run out of ink while printing, the print head nozzle may become clogged and the ink expulsion mechanism may not fire, amongst other malfunctions. Evidence of such malfunctions are usually detected when the printed document is pulled out of the printer and examined visually. At this point it is too late for appropriate correction. Some types of electronic sensing are known in the art, such as techniques for detecting when an ink expulsion mechanism has not fired. These techniques, however, are limited in scope and do not, for example, detect when a nozzle is clogged or unclogged.

A need thus exists to detect print head malfunction in such a manner as to eliminate or minimize corruption of a printed image. Early detection of a malfunction permits preventative steps to be taken such as print head replacement or software based compensation within the firing algorithm, etc.

SUMMARY OF THE INVENTION

Accordingly, it is an object of the present invention to provide a print head that can detect a malfunction therein.

It is another object of the present invention to provide a print head that can detect such conditions as a clogged nozzle, no fire and dry fire.

It is another object of the present invention to provide a print head that incorporates a pressure sensor and circuitry therefor that detects firing of an ink expulsion mechanism and determines characteristics about the firing based on the sensed signals.

It is also an object of the present invention to provide a print head with a piezoelectric type pressure sensor.

These and related objects of the present invention are achieved by use of a print head apparatus with a malfunction detector as described herein.

The attainment of the foregoing and related advantages and features of the invention should be more readily apparent to those skilled in the art, after review of the following more detailed description of the invention taken together with the drawings.

DETAILED DESCRIPTION

Figure 1:
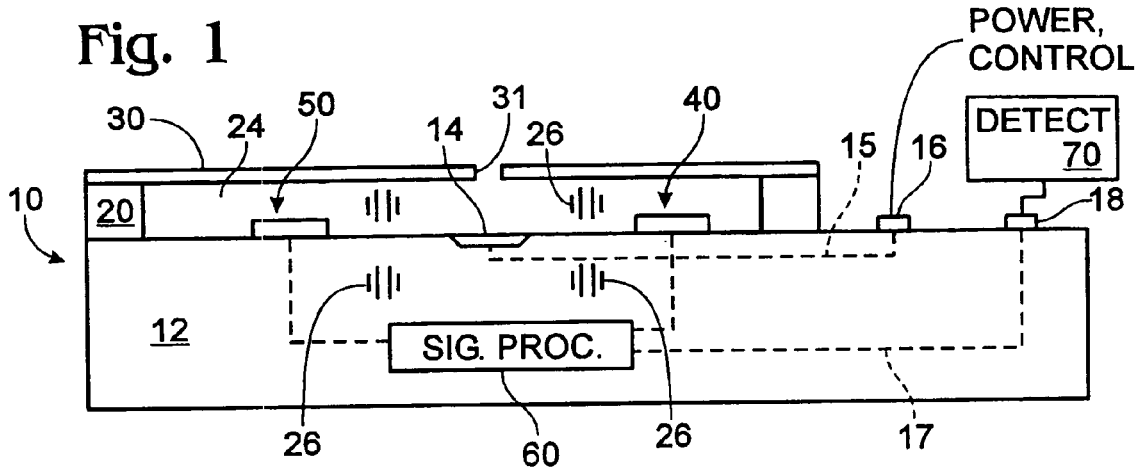
FIG. 1 is a cross sectional side view of a print head in accordance with the present invention.

Referring to FIG. 1, a cross sectional side view of a print head 10 in accordance with the present invention is shown. Print head 10 includes a substrate in or on which is provided an ink expulsion mechanism 14. Ink expulsion mechanism 14 may expel ink through thermal or mechanical excitation or through other appropriate expulsion means. In a preferred embodiment, mechanism 14 is thermally actuated and may be implemented with a resistive element as is known in the art. Ink expulsion mechanism 14 is controlled by off-die circuitry or by a combination of on-die and off-die circuitry as is known. Representative off-die coupling is indicated by signal line 15 and contact pad 16.

A barrier layer 20 is formed on substrate 12 and an orifice plate 30 is formed on barrier layer 20. The substrate, barrier layer and orifice plate define an ink well or conduit 24 that channels ink from a supply (not shown) into proximity with the expulsion mechanism. An orifice or nozzle 31 through which ink is expelled is formed in the orifice plate and positioned over ink expulsion mechanism 14. Suitable material for barrier layer 20 and orifice plate 30 are known in the art.

Assuming that ink expulsion mechanism 14 is a thermally actuated device such as a resistor, an ink drop is expelled by essentially boiling a drop of ink through nozzle 31. During formation and collapse of a boiling ink bubble, a series of acoustic pressure waves 26 (hereinafter referred to as "pressure waves") are produced. These waves propagate through the components of the print head, including primarily the substrate and ink well.

In the substrate (and conventional thin film layers formed thereon), both longitudinal and shear waves are produced. Longitudinal waves can be detected by an interdigitated piezoelectric pressure wave transducer 50 or the like which is described in more detail with reference to FIGS. 3 and 4. In the ink well-24, longitudinal pressure waves are produced. These waves can be detected with a piezoelectric acoustic pressure wave transducer 40 which is described in more detail with reference to FIG. 2.

For purposes of the present discussion, the term "interdigitated transducer" will be used for the interdigitated piezoelectric pressure wave transducer and the term "acoustic transducer" will be used for the piezoelectric acoustic pressure wave transducer. While both an acoustic transducer and an interdigitated transducer are described as being provided on substrate 12, it should be recognized that they need not be provided together because either transducer is capable of sufficiently detecting pressure waves. The provision of both provides redundancy.

Acoustic transducer 40 and interdigitated transducer 50 are preferably coupled to processing circuit 60. Processing circuit 60 preferably includes an amplifier, a filter and an analog to digital converter or related signal processing circuitry. Processing circuit 60 may be configured to provide the necessary processing to determine dry-fire, no-fire and clogged-fire conditions (that is, a misfire) or the sensor output signals can be delivered to off-die logic 70 for such processing. The output of processing circuit 60 is propagated over signal line 17 to contact pad 18.

Figure 2:
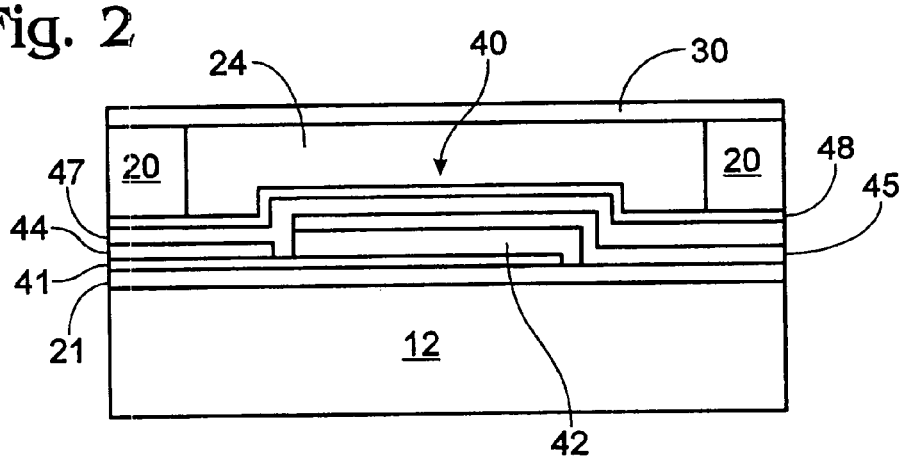
FIG. 2 is a side view of a piezoelectric acoustic wave transducer in accordance with the present invention.

Referring to FIG. 2, a side view of an acoustic transducer in accordance with the present invention is shown. FIG. 2 illustrates the acoustic transducer of FIG. 1 in more detail. FIG. 2 illustrates substrate 12 on which the following layers are formed: an insulation layer 21, a conductive coupling layer 41, piezoelectric material 42, a first and a second signal conductive layer 44,45, a passivation layer 47 and a surface coat layer 48. In a preferred embodiment, these layers are made of the following or a like material: insulation layer 21 is silicon dioxide (SiO2), conductive layer 41 is tantalum aluminum (TaAl), piezoelectric material 42 is aluminum nitride (AlN), first and second conductive layers or traces 44,45 are aluminum (Al), passivation layer 47 includes a first layer of silicon nitride ($Si_3N_4$) and a second layer of silicon carbide (SIC), and coating layer 48 is tantalum (Ta). It should be recognized that the arrangement and composition of these layers may be altered in a manner consistent with device fabrication techniques without deviating from the present invention. It should also be recognized that other piezoelectric material such as zinc oxide (ZnO) or PZT may be used and that other types of suitable pressure sensors may be used.

The first and second conductive layers 44,45 form conductors for reading a voltage generated by piezoelectric material 42 in response to an incident pressure wave. A pressure wave traveling through the ink well compresses the thin film stack, resulting in a mechanical strain in the thin film layers. In the piezoelectric layer, this strain produces a measurable electric charge across the two conductors.

Figure 3:
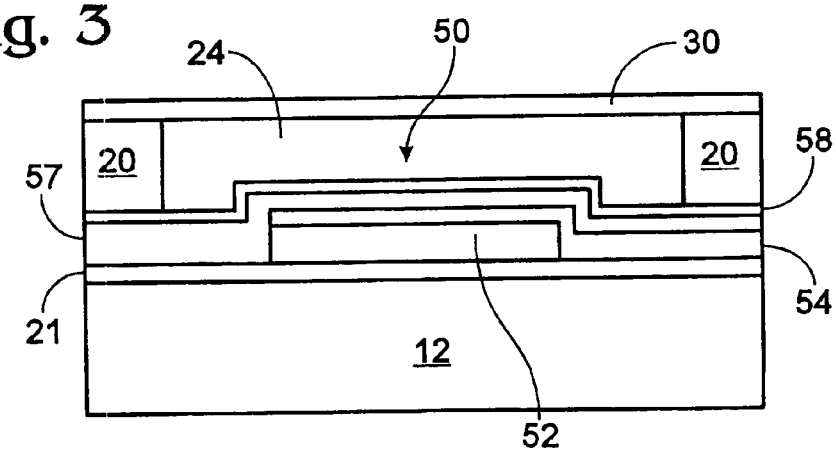
FIG. 3 is a side view of a portion of an interdigitated pressure wave transducer in accordance with the present invention.
Figure 4:
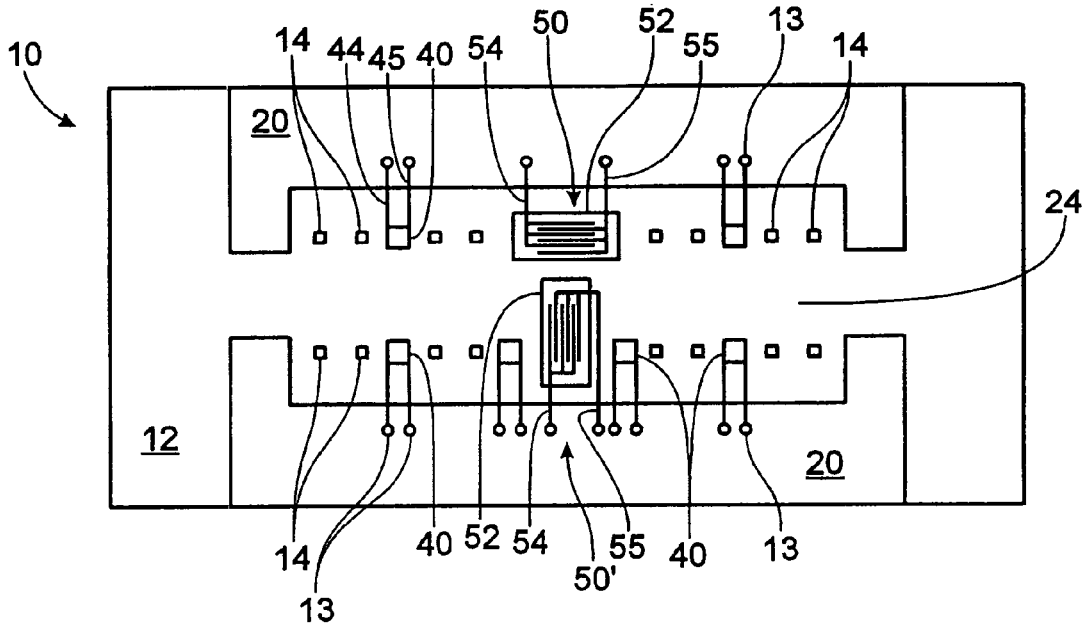
FIG. 4 is a plan view of an arrangement of piezoelectric acoustic pressure wave transducers and interdigitated piezoelectric pressure wave transducers in a print head in accordance with the present invention.

Referring to FIG. 3, a side view of a portion of an interdigitated transducer in accordance with the present invention is shown. FIG. 3 illustrates the interdigitated transducer of FIG. 1. The layout of this transducer and its arrangement with another interdigitated transducer are shown in FIG. 4. FIG. 3 illustrates substrate 12 on which are formed insulation layer 21, piezoelectric material 52, first and second conductors 54,55 (only one of which is shown), a passivation layer 57 and a coating layer 58. The substrate, insulation layer, passivation layer and coating layer are as discussed above for acoustic transducer 40. The piezoelectric material and conductive layers are preferably similar in composition to their counterparts in transducer 40, however, their areal arrangement is different as shown in FIG. 4.

Referring to FIG. 4, a plan view of an arrangement of acoustic transducers and interdigitated transducers in a print head in accordance with the present invention is shown. FIG. 4 illustrates substrate 12, a plurality of ink expulsion mechanisms 14, barrier layer 20, ink well 24, a plurality of acoustic transducers 40 and a plurality of interdigitated transducers 50. Orifice plate 30 would be placed over the arrangement of FIG. 4 with nozzles aligned with the ink expulsion mechanisms 14. It should be recognized that the transducer arrangement disclosed in FIG. 4 is representative and provided for pedagogical purposes. The ink expulsion mechanisms, ink well and the size, number and arrangement of transducers may be modified from that of FIG. 4 without departing from the present invention. Furthermore, it should be recognized that although the interdigitated transducers are shown in the ink well, since they detect pressure waves in the substrate they may be placed anywhere on the substrate including under the barrier layer.

The interdigitated transducers are preferably implemented as interdigitated conductors 54-55 placed over a corresponding pattern of piezoelectric material 52. These interdigitated transducers exhibit a directional detection characteristic that is advantageous to some implementations of the present invention. FIG. 4 illustrates two interdigitated pressure wave transducers 50 and 50' that are arranged orthogonally to one another. This arrangement facilitates detection of pressure waves traveling in different directions. The acoustic transducers 40 of FIG. 4 are essentially as described above with references to FIGS. 1 and 2. Each of transducers 40 and 50 are shown with their first and second conductors 44, 45 and 54, 55, respectively being coupled to vias 13 (under the barrier layer) that are coupled to signal processing circuit 60 of FIG. 1.

Figure 5:
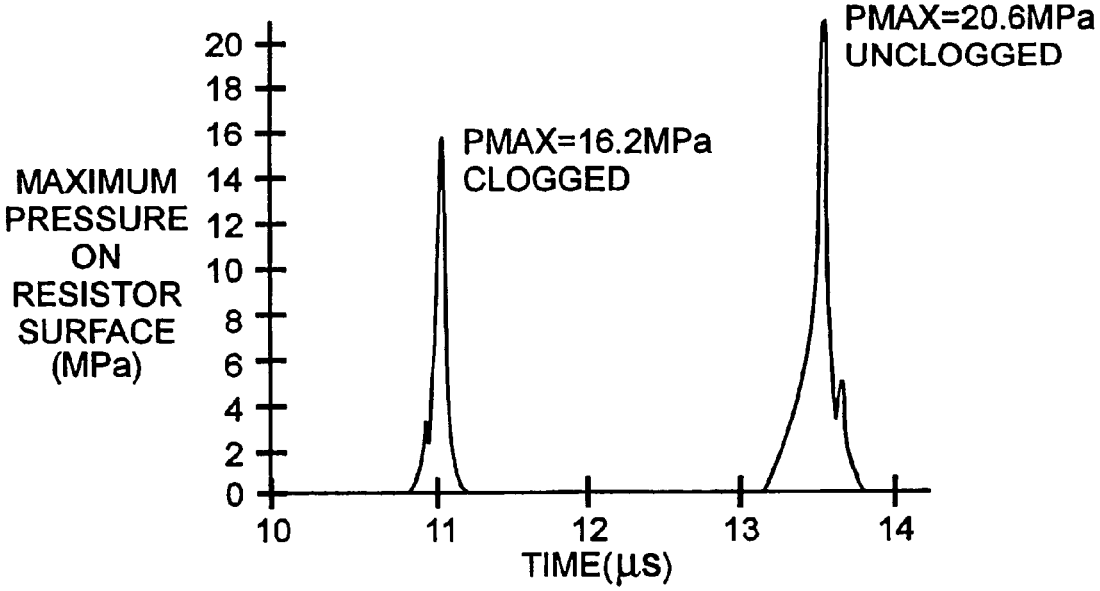
FIG. 5 is a graph illustrating the pressure on an expulsion mechanism surface versus time for a clogged nozzle firing and an unclogged nozzle firing.

Referring to FIG. 5, a graph illustrating the pressure on the surface of resistor or expulsion mechanism 14 verses time for a clogged nozzle firing and an unclogged nozzle firing is shown. As alluded to above, the cavitation of the air bubble(s) at resistor or expulsion mechanism 14 during firing causes a considerable pressure spike on the surface of the resistor. This pressure spike is normally around 20 MPa (greater than 10K PSI) and occurs at approximately 13.5 μS after firing. When the nozzle associated with a particular resistor is clogged, however, the pressure spike has a different signature. Typically it is lower in magnitude by about 15-25 percent (e.g., approximately 16 Mpa) and occurs earlier (e.g., 15-20% earlier, usually approximately 11 μS). The combination of decreased magnitude and quicker response time permits differentiation of an unclogged firing from a clogged firing. The absence of a pressure wave indicates a "no-fire" event.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A method of monitoring performance of a print head, comprising the steps of:

predefining a first timing of a pressure wave generated by a successful expulsion of a volume of ink through a nozzle of a print head;

attempting expulsion of said volume of ink through said nozzle;

detecting within said print head a second timing of a pressure wave generated by said attempt to expel said volume of ink; and determining that said nozzle is clogged if said second timing is in the range of 15% to 20% earlier than said first timing.

2. The method of claim 1, wherein said detecting step includes the step of detecting the presence or absence of a pressure wave.

3. The method of claim 1, comprising the steps of:

predefining a first magnitude of said pressure wave related to a successful expulsion of said volume of ink;

detecting a second magnitude of said pressure wave generated by said attempt to expel said volume of ink; and determining that said nozzle is clogged if said second magnitude is in the range of 15% to 25% less than said first magnitude.

4. A method of detecting a misfiring nozzle in an inkjet printhead comprising the steps of:

establishing a first timing of an arrival of a pressure wave from an ejection of a predetermined volume of ink from a properly operating nozzle; and responsive to an attempted ejection of said predetermined volume of ink from said misfiring nozzle, detecting a second timing of an arrival of a pressure wave in the range of 15% to 20% earlier than said first timing, said second timing identifying a clog in the misfiring nozzle.

5. The method of claim 4, comprising the steps of:

establishing a first non-zero magnitude of a pressure wave corresponding to an ejection of a predetermined volume of ink from the properly operating nozzle; and detecting a second non-zero magnitude of a pressure wave in the range of 15% to 25% less than said first magnitude, said second non-zero magnitude identifying a clog in the misfiring nozzle.

6. The method of claim 4, wherein said first timing corresponds to a successful ejection of said predetermined volume of ink from said properly operating nozzle.

7. A method of monitoring performance of a print head, comprising:

predefining a first timing of a pressure wave generated by an expulsion of a desired volume of ink through an unclogged nozzle of a print head;

attempting expulsion of said desired volume of ink through a clogged nozzle of the print head;

detecting within said print head a second timing of a pressure wave generated by said attempted expulsion; and recognizing that said clogged nozzle is clogged if said second timing is in the range of 15% to 20% earlier than said first timing.

* * * * *

UNITED STATES PATENT AND TRADEMARK OFFICE

CERTIFICATE OF CORRECTION

PATENT NO. : 7,717,531 B2
APPLICATION NO. : 11/479096
DATED : May 18, 2010
INVENTOR(S) : Robert Paasch It is certified that error appears in the above-identified patent and that said Letters Patent is hereby corrected as shown below:

In column 2, line 49, after "well" delete "-24".

Signed and Sealed this

Seventeenth Day of August, 2010

David J. Kappos

David J. Kappos
*Director of the United States Patent and Trademark Office*